US007445322B2

(12) United States Patent
Kitabatake et al.

(10) Patent No.: US 7,445,322 B2
(45) Date of Patent: Nov. 4, 2008

(54) LIQUID STORING CONTAINER AND RECORDING APPARATUS

(75) Inventors: Kenji Kitabatake, Kawasaki (JP); Keisuke Matsuo, Yokohama (JP); Masashi Ogawa, Kawasaki (JP); Hiromasa Amma, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 404 days.

(21) Appl. No.: 11/295,537

(22) Filed: Dec. 7, 2005

(65) Prior Publication Data

US 2006/0139384 A1 Jun. 29, 2006

(30) Foreign Application Priority Data

Dec. 8, 2004 (JP) ..... 2004-356056

(51) Int. Cl.
*B41J 2/175* (2006.01)

(52) U.S. Cl. ..... 347/86

(58) Field of Classification Search ..... 347/5, 347/7, 19, 49, 86, 87

See application file for complete search history.

(56) References Cited

U.S. PATENT DOCUMENTS

| | | | | |
|---|---|---|---|---|
| 5,616,929 | A | 4/1997 | Hara | 250/573 |
| 5,997,121 | A * | 12/1999 | Altfather et al. | 347/7 |
| 6,097,405 | A * | 8/2000 | Lo et al. | 347/6 |
| 6,454,400 | B1 | 9/2002 | Morita et al. | 347/86 |
| 6,616,255 | B2 * | 9/2003 | Murakami et al. | 347/7 |
| 6,848,776 | B2 * | 2/2005 | Nishioka et al. | 347/86 |
| 6,869,158 | B2 | 3/2005 | Kojima et al. | 347/19 |
| 7,213,914 | B2 * | 5/2007 | Anma et al. | 347/86 |
| 2006/0082625 | A1 | 4/2006 | Kotaki et al. | 347/86 |
| 2006/0087538 | A1 | 4/2006 | Amma et al. | 347/86 |

FOREIGN PATENT DOCUMENTS

| | | |
|---|---|---|
| JP | 60-31021 | 2/1985 |
| JP | 2-102062 | 4/1990 |

* cited by examiner

*Primary Examiner*—Anh T. N. Vo
(74) *Attorney, Agent, or Firm*—Fitzpatrick, Cella, Harper & Scinto

(57) ABSTRACT

A liquid storing container having a liquid storing chamber for storing liquid, the liquid container includes a plurality of light-transmissive prisms for forming interfaces with the liquid or gas in the liquid storing chamber; wherein each of the prisms includes at least one surface contactable to the liquid in the liquid storing chamber, wherein each of the prisms includes a surface integral with a surface constituting a part of the liquid storing chamber, and wherein the prisms are substantially diagonally disposed in the liquid storing chamber.

3 Claims, 15 Drawing Sheets

LIQUID STORING CONTAINER AND RECORDING APPARATUS

FIELD OF THE INVENTION AND RELATED ART

The present invention relates to a liquid container usable with a recording apparatus for effecting recording by ejecting liquid from a recording head, and a recording apparatus which performs recording operation using such a liquid container.

In the present invention, the liquid may be ink containing predetermined coloring material or transparent processing liquid used to enhance the coloring property of the ink and the durability of the ink on the recording material or the like.

In the following description, they are all called simply "ink"

An ink jet recording apparatus is known which is provided with means for automatically detecting a remaining amount of the ink in the liquid storing container for supplying the ink to the recording head, and for providing the user with a warning signal. For this purpose, for example, a means is proposed and implemented in which electrodes are provided in the ink container to detect the electric conduction between them or in which a light transmittance of the ink is detected.

However, the means for detecting the presence or absence of the ink using the electrodes leads to the complication of the structure of the ink container per se, and from the foregoing, the optical detecting means is preferred.

The ink containers provided with the optical ink detecting means are proposed in Japanese Laid-open Patent Application Sho 60-031021, Japanese Laid-open Patent Application Hei 02-102062, U.S. Pat. No. 5,616,929, for example.

Referring first to FIG. 18, there is shown a conventional example of a structure of the remaining ink amount detecting means which optically detects the remaining amount of the ink.

In this Figure, designated by reference numeral 101 is an ink container; 102 is a prism which is a triangular prism having an apex angle of 90° in this example; 103 is a light emission element in the form of an infrared radiation LED or the like; 104 is a light receiving element such as a phototransistor and 105 is ink.

The ink container 101 is made of a semi-transparent plastic resin material and accommodates the ink. The bottom portion is provided with a prism 102 which functions as an optical ink detection portion. The prism 102 is molded integrally with the ink container 101 and is made of substantially transparent material such as polypropylene resin material.

With this structure, when such an ink container 101 is filled with the ink 105, the light emitted from the light emission element 103 is incident on the interface 102A at an incident angle of 45°.

The refractive index of the prism 102 of polypropylene is 1.48, and that of the ink 105 is 1.35.

Then, the light incident on the interface between the prism 102 and the ink 105 is refracted with the refraction angle of approx. 51° and is absorbed in the ink. As a result, the light quantity reaching the light receiving element 104 is significantly small (almost zero), and therefore, the output from the light receiving element 104 is zero.

On the other hand, when all the ink 105 in the ink container 101 is consumed up, the prism 102 contacts the air.

Therefore, the light incident on the interface from the light emission element 103 is reflected by total reflection at the boundary interfaces 102A and 102B between the prism 102 and the air, which has a refractive index of approx. 1.0003.

The light receiving element 104 now receives the light to produce an output voltage.

Therefore, the output signal level of the light receiving element changes by the difference in the amount of the light incident on the light receiving element 104, and the presence or absence of the ink 105 in the ink container 101 can be detected.

On the other hand, the recent variegation of use necessitates the usability with wide range of orientation of the ink container. More particularly, the ink containers are used with horizontal and vertical orientations.

With such variations, ink containers used in different orientations are manufactured. For example, ink containers for vertical use are manufactured, and on the other hand and ink containers for horizontal use are also manufactured.

An ink container usable in different orientations, such as an ink container both for vertical use and horizontal use is desired.

However, in the case of the system in which the remaining ink amount is detected optically with the use of a prism or the like, the level of the ink is different if the orientation of the ink container is different.

However, there is a difficulty in doing so.

In detecting the remaining ink amount in the ink container, it is desirable that optical detection portion such as a prism is disposed at the bottommost portion of the container, since then substantially the completely empty state can be detected.

However, it is difficult to satisfy this in different use orientation of attitude.

The latitude in the design of the ink container and the recording apparatus is significantly limited.

SUMMARY OF THE INVENTION

Accordingly, it is a principal object of the present invention to provide a liquid container and a recording apparatus wherein the remaining ink amount can be detected correctly by optical detecting means in different orientations of use.

According to an aspect of the present invention, there is provided a liquid storing container having a liquid storing chamber for storing liquid, said liquid container comprising a plurality of light-transmissive prisms for forming interfaces with the liquid or gas in the liquid storing chamber; wherein each of said prisms includes at least one surface contactable to the liquid in said liquid storing chamber, wherein each of said prisms includes a surface integral with a surface constituting a part of said liquid storing chamber, and wherein said prisms are substantially diagonally disposed in said liquid storing chamber.

According to another aspect of the present invention, there is provided a liquid container having a liquid storing chamber for storing liquid and usable in a plurality of orientations, said liquid container comprising wherein said liquid storing chamber has a plurality of light-transmissive prisms for forming interfaces with the liquid or gas in the liquid storing chamber, and said prisms are disposed at respective positions corresponding to the orientations.

The prisms may be provided at two positions corresponding to the orientations, respectively.

In a first one of the orientations, a liquid supply port for supplying the liquid out of the liquid container may face down, and in a second one of the orientations, the liquid supply port may face horizontally.

One of said prisms may be for detecting an amount of the remaining liquid in said liquid storing chamber, and the other may be for detecting presence or absence of said liquid container or for detecting properness of mounting of liquid container.

When a surface of one of said prisms forms an interface with the liquid, at least one of the surfaces of the other prism may form an interface with the gas.

The liquid container may be detachably mountable to a holding member having a liquid ejecting head for a recording apparatus.

The liquid container may contain the liquid for use by a liquid ejecting head for a recording apparatus.

According to a further aspect of the present invention, there is provided a recording apparatus usable with a liquid container having a liquid storing chamber for storing liquid, wherein said recording apparatus is operable in a plurality of orientations, said recording apparatus including detecting means for detecting an amount of the remaining liquid in said liquid container, said recording apparatus, wherein said liquid storing chamber has a plurality of light-transmissive prisms for forming interfaces with the liquid or gas in the liquid storing chamber, and said prisms are disposed at respective positions corresponding to the orientations of said recording apparatus, and wherein said amount of the remaining liquid detecting means are disposed correspondingly to the respective prisms, and include light emitting portions for emitting light to be incident on said interfaces at predetermined incident angles, and light receiving portions for receiving the light reflected by said interfaces at predetermined reflection angles to produce predetermined detection signals, and discriminating means for discriminating whether or not a remaining amount in the liquid storing chamber reaches a predetermined level, on the basis of outputs of said light receiving portions.

With such a structure, the remaining amount of the ink can be detected even if the orientation of the ink container is different.

In addition, the overall manufacturing cost of the ink containers usable with different orientations can be reduced.

Therefore, the present invention is contributable to the variegation of the recording apparatus.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 4(*b*) shows a mounting process of the ink container of the embodiment of the present invention to the head cartridge wherein the ink container is being mounted.

FIG. 4(*c*) shows mounting process of the ink container of the embodiment of the present invention to the head cartridge wherein the ink container has been mounted thereto.

FIG. 15(*b*) is sectional view of the ink container of the fourth embodiment in horizontal use as seen from a lever.

DESCRIPTION OF THE PREFERRED EMBODIMENTS

The preferred embodiments of the present invention will be described in conjunction with the accompanying drawing.

First Embodiment

Figure 1:
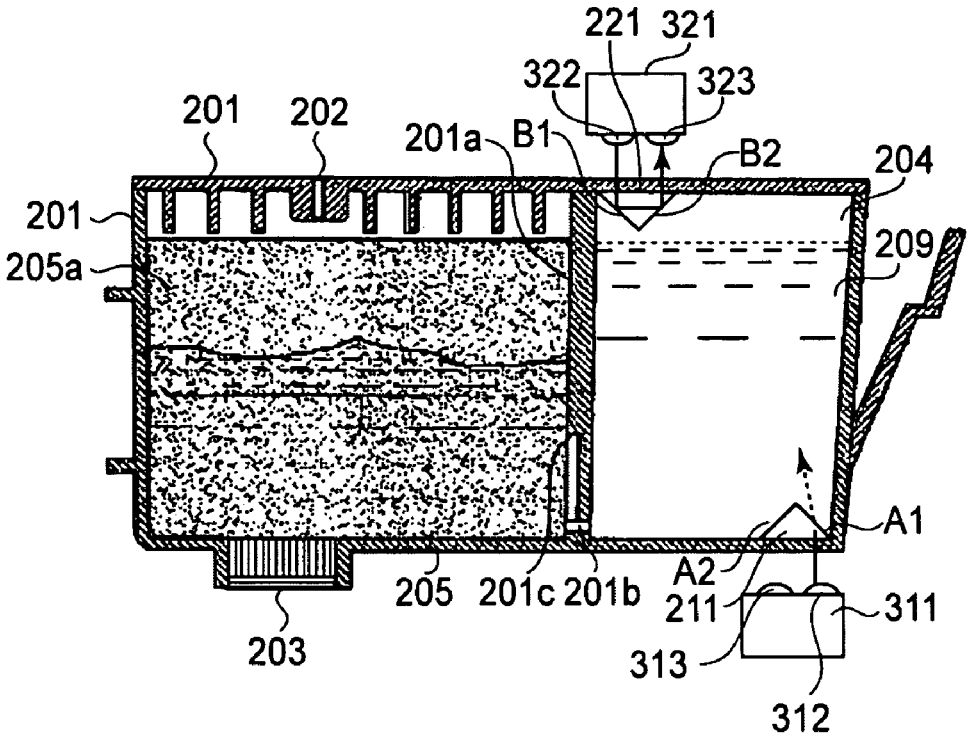
FIG. 1 is a sectional side elevation of an ink container in horizontal use according to a first embodiment of the present invention at the initial stage of use.
Figure 16:
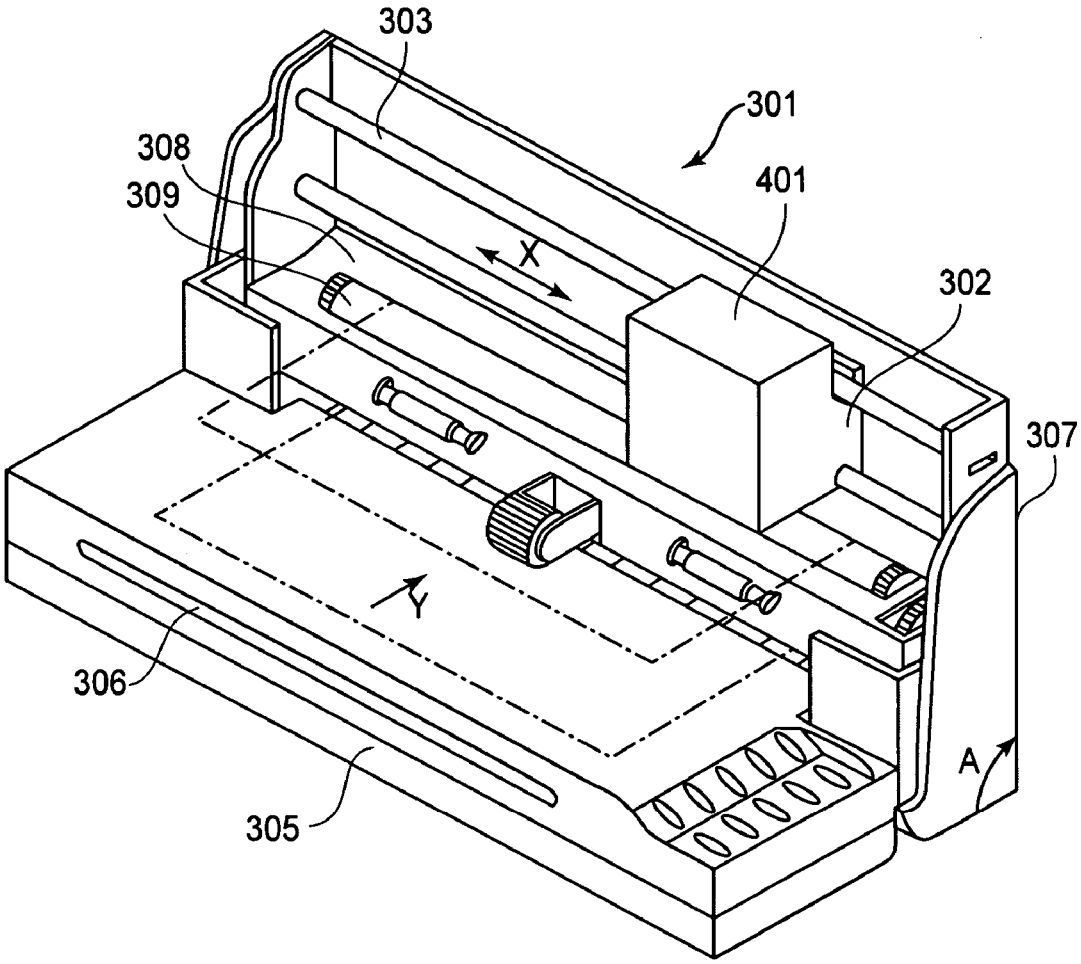
FIG. 16 is a perspective view of an ink jet recording apparatus according to an embodiment of the present invention.

Referring to FIG. 1, there is shown an ink container of the first embodiment of the present invention which is at the initial stage of use, and FIG. 16 is a perspective view of an ink jet recording apparatus with which the ink container is usable.

In FIG. 1, the ink container 200 comprising a casing 201 of a generally rectangular parallelopiped configuration. The inside of the casing 201 is partitioned by a partition 201*a* into an ink chamber 204 for storing ink 209 and an absorbing material chamber 205 accommodating an absorbing material impregnated with ink.

The ink chamber 204 and the absorbing material chamber 205 are in fluid communication with each other by a communication port 201*b* provided at the bottom end portion of the partition 201*a*, and the ink contained in the ink chamber 204 is supplied into the absorbing material chamber 205 through the communication port 201*b*. The inner surface of the partition 201*a* at the absorbing material chamber 205 is provided with an ambient air introduction path 201*c* in the form of a groove having a predetermined length, and the groove is in fluid communication with the communication port 201*b*.

The lower portion (bottom portion) of the absorbing material chamber 205 is provided with an ink supply port 203 for discharging the ink out of the ink container 200. The absorbing material chamber 205 has an air vent 202 for introducing the ambient air.

As shown in FIG. 1, the ink container is in the state of horizontal use which is defined as the state in which the ink supply port 203 faces down, and a bottom side means the side which takes the bottom portion in use.

The casing 201 of the ink container 200 is made of transparent resin material. In this embodiment, the resin material is polypropylene resin having a refractive index of 1.48. In the ink chamber 204, there are provided two prisms A211, B221 each having a triangular cross-section.

The prism A211 (first optical portion to be detected) is integrally molded at the bottom side of the casing 201 of the ink container 200, and the two surfaces A1, A2 of the prism A211 is in the ink chamber 204. The other side of the prism B221 forms a part of the outer surface of the ink container 200 (bottom surface).

The prism (second optical portion to be detected) B221 is integrally molded at the position of the upper side of the casing 201, and the surfaces B1, B2 of the prism B221 are in the ink chamber 204.

The other side of the prism B221 forms a part of the outer surface of the ink container 200 (top surface). The two prisms A211, B221 are disposed at different positions but have the same cross-sectional configuration.

The ink chamber 204 contains the ink 209 and air, and the air takes an upper position and the ink 209 takes the lower position in the ink chamber 204 by the gravity.

The ink container 200 is detachably mountable into a head cartridge 401 for use with the ink jet recording apparatus 301 of serial printing type.

The head cartridge 401 is mounted on a carriage 302 of the ink jet recording apparatus 301.

Figure 2:
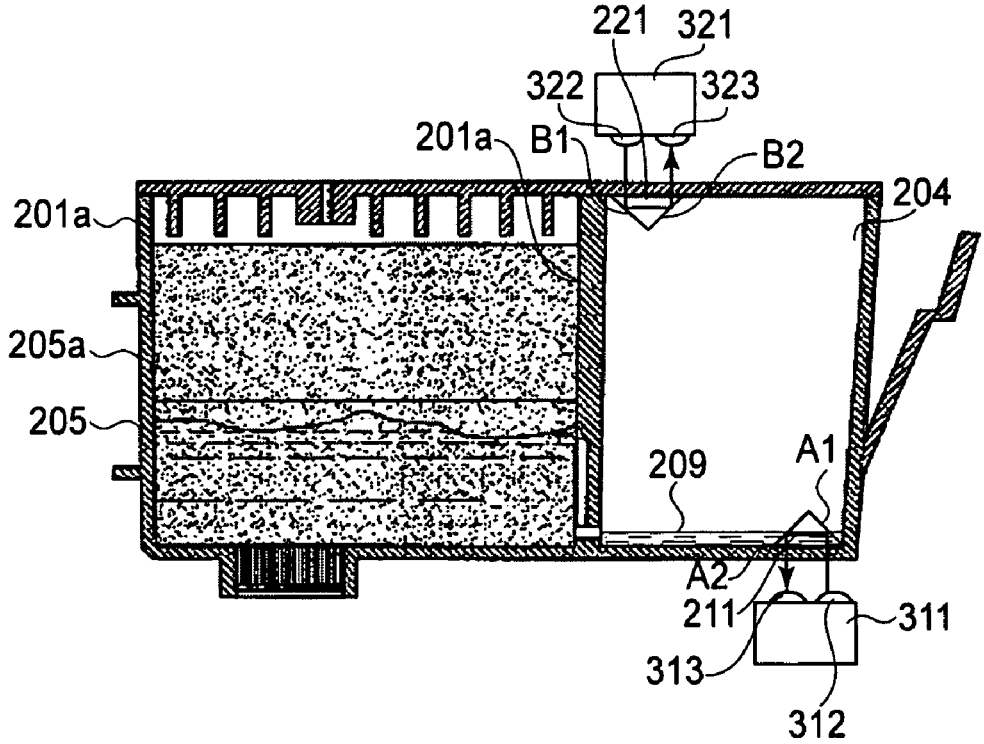
FIG. 2 is a sectional side elevation of the ink container of the first embodiment in horizontal use wherein the ink container is empty.

The ink jet recording apparatus 301 comprises two sensors, namely, sensors A311, A321 as shown in FIGS. 1 and 2 as optical detecting means for detecting the remaining ink amount in the ink container.

The location of the sensor A311 is as follows.

This is such a position that sensor A311 faces the prism A211 of the ink container 200 carried on the carriage 302 when the carriage 302 scanningly moving along the guiding shaft 303 is at a predetermined position (home position, for example).

The sensor A311 has as a unit a light emission element (projector) 312 emitting light (infrared radiation, for example) and a light receiving element 313 (photoreceptor) for receiving the light to generate a predetermined voltage (detection signal).

The sensor B321 is correspondingly disposed at such a position that it faces the prism B221 of the ink container 200 when the carriage 302 is at the predetermined position.

The sensor A321 is also has as a unit a light emission element (projector) 322 emitting light (infrared radiation, for example) and a light receiving element (photoreceptor) 323 for receiving the light to generate a voltage. The detail of the recording apparatus 301 will be described hereinafter.

FIG. 1 shows an initial stage state of the ink container 200, wherein the user has just mounted the ink container 200 to the printer, and the ink 209 has not yet consumed for printing operation.

In this state, the prism A211 takes a bottom position of the ink container 200, and therefore, the two surfaces A1, A2 of the prism A211 are in contact with the ink in the ink chamber 204. The two surfaces B1, B2 constituting the prism B221 is surrounded by the air in the ink chamber 204.

When the ink container 200 is mounted to the ink jet recording apparatus 301, the carriage 302 is moved along the guiding shaft 303.

Then, the carriage stops at such a position that prism A211 and the prism B221 face the sensor A311 and the sensor B321 of the ink jet recording apparatus 301, respectively.

The light emitted from the light emission element 312 of the sensor A311 is incident on the third surface of the prism A211 which is a part of the outer surface of the ink container bottom.

Figure 3:
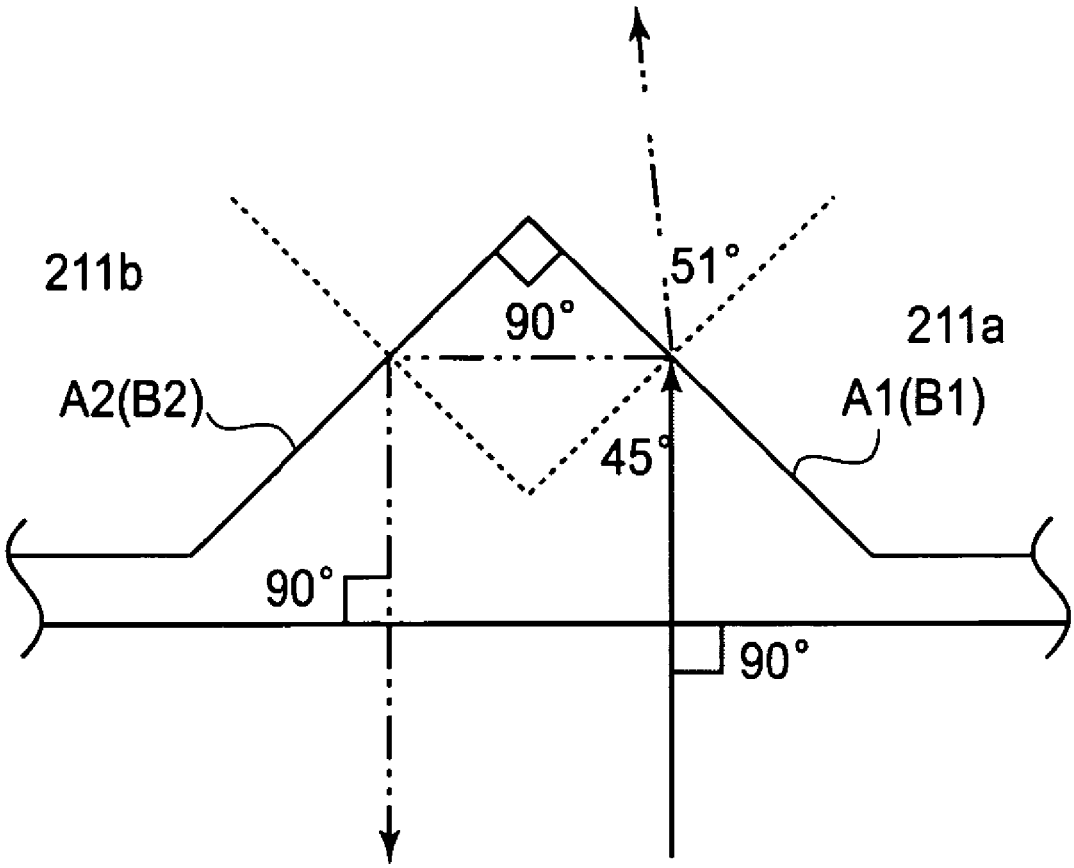
FIG. 3 is an enlarged view of a prism used in the embodiment of the present invention.

Referring to FIG. 3, the angle formed between the incident light to the prism and the third surface of the prism (outer bottom surface of the ink container) is 90°, and therefore, the incident light is not refracted thereat and travels into the ink container 200 through the casing (solid line arrow in FIG. 3).

The two surfaces constituting the prism A211, namely, the interface A211*a* and the interface B211*b* in FIG. 3 form an angle of 90°, and project into the ink chamber 204. The light is incident on the interface A211*a* at the incident angle of 45°.

Interface A211*a* is between the polypropylene resin of the casing of the ink container 200 and the ink 209. Since the ink has a refractive index of approx. 1.35, and the refraction angle θAa at the interface A211*a* is determined by the Snell's law, as follows:

$$\sin \theta Aa = 1.48/1.35 \times \sin 45°$$

From this, θAa=51°.

Thus, the light is refracted at the refraction angle as indicated by the chain line arrow and travels into the ink. In this manner, no optical path is formed to the light receiving element 313, and therefore, the light receiving element 313 generates no output voltage. By the output voltage (output signal) of the light receiving element 313, the presence of the ink in the ink container 200 is detected. The output signal from the light receiving element 313 is transmitted to the controller of the ink jet recording apparatus, and the control means discriminates the presence of the ink in the ink container 200.

On the other hand, the light emitted from the light emission element 322 of the sensor B321 is directed to the prism B221 and is incident on the top outer surface (the third surface of the prism B221) of the ink container 200.

Referring to FIG. 3, the incident angle of the light incident on the prism B221 at the top of the container is substantially 90°, and therefore, the incident light is not refracted and travels into the ink container 200 through the casing 201.

The two surfaces constituting the prism B221, namely, the surface B1 and the surface B2 shown in FIG. 3 form an angle of 90° and project into the inside of the ink chamber 204. The incident light reaches the interface B1 at an incident angle of 45°.

The surface B1 constitutes an interface between the air and the polypropylene of the casing of the ink container 200, and the refractive index of the air is approx. 1, and the refraction angle θBa at the interface A1 is determined by the Snell's law, as follows:

$$\sin \theta Ba = 1.48/1 \times \sin 45° > 1$$

This means that total reflection condition is satisfied. Therefore, the light incident on the surface B1 is subjected to the total reflection, travels in the prism B221 and reaches the surface B2 (FIG. 3) which is another surface of the prism B1.

The incident angle of the light incident on the surface B2 is 45°, and therefore, the light is totally reflected again by the surface B2 and is directed to the top outer surface (the third surface of the prism B221) toward the outside.

This is shown by a chain line in FIG. 3.

The returned light is received by the light receiving element 323, and therefore, a voltage is produced in the light receiving element 323. On the basis of the output voltage (output signal) of the light receiving element 323, the mounting of the ink container 200 on the carriage is discriminated.

The output signal of the light receiving element 323 is transmitted to the controller of the ink jet recording apparatus, and the control means discriminates the presence of the ink container 200.

The description will be made as to the detection of the remaining ink amount when the ink in the ink container 200 is consumed.

The ink is ejected by the recording head of the head cartridge 401 mounted in the recording apparatus 301.

The ink in the absorbing material chamber 205 is consumed by which the level of the ink, namely, the interface between the ink and the air in the absorption chamber 205 lowers.

When the ink is consumed to such an extent that ink level lowers to a predetermined position beyond the upper end of the ambient air introduction path 201*c*, the air is introduced through the air vent 202 into the ink chamber 204 through the ambient air introduction path 201*c* and the fluid communication path 201*b*.

Simultaneously, the ink in the ink chamber 204 is supplied into the absorbing material chamber 205, by which the level of the ink in the ink chamber 204 lowers. The exchanging operation between the introduced air and the liquid in the absorbing material chamber 205 and the ink chamber 204 is called gas-liquid exchange.

FIG. 2 is a sectional side elevation of the container wherein the ink in the ink chamber 204 has been consumed to the neighborhood of the bottom portion so that two surfaces A1, A2 of the prism A211 is exposed to the air.

In this state, the two surfaces A1, A2 of the prism A211 constitute interfaces with the air, similarly to the prism B221.

Similarly to the prism B221, the light emitted from the sensor A311 is transmitted through and reflected in the prism A211 to return to the outside. The returned light is detection by the light receiving element 313, so that event of the arrival of the ink level in the ink container 200 at the neighborhood of the bottom portion is detected.

In such a state, there exists an optical path from the light emission element 322 to the light receiving element 323 similarly to the state of FIG. 1.

This is shown by chain lines in FIG. 3.

Therefore, the mounting of the ink container 200 can be detected.

Figure 4:
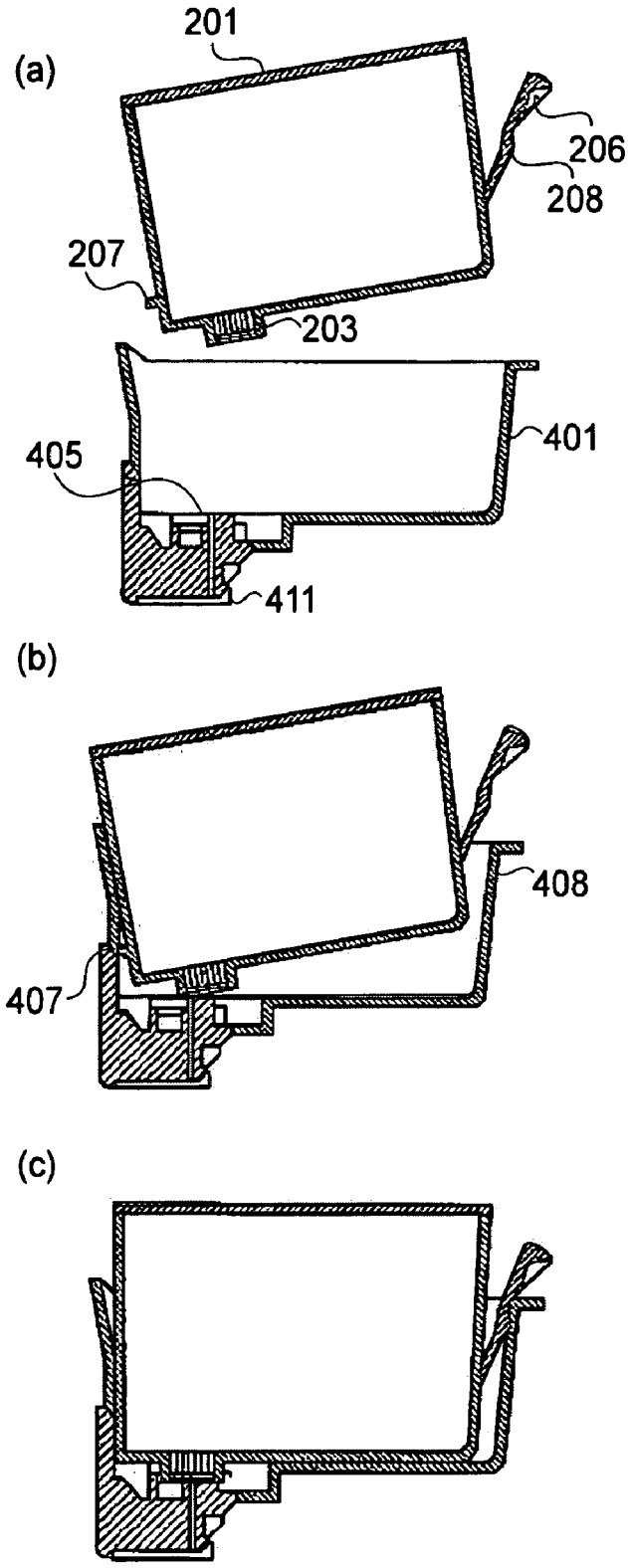
FIG. 4(*a*) shows a mounting process of the ink container of an embodiment of the present invention to the head cartridge wherein the ink container is not yet mounted.

As will be understood from FIG. 4, the ink container 200 is mounted into the head cartridge 401 while substantially rotating.

In FIG. 4(*a*) shows the state before the ink container 200 is mounted to the head cartridge 401, and (b) shows the state during the mounting operation of the ink container 200 to the head cartridge 301.

In the same Figure, (c) shows the state after completion of the mounting of the ink container 200 to the head cartridge 401. The ink container 200 is provided at its front side with a first engaging claw and is provided at a rear side with a latch lever 206 having a second engaging claw.

In the mounting process of the ink container 200, the first engaging claw 207 provided at the front side is first engaged with the first engaging hole 407 of the head cartridge 401 (FIG. 4(*b*)).

Then, the rear part of the ink container 200 is pushed by the user to rotate the ink container 200 about the neighborhood of the first engagement claw.

During the pushing, the deformation bends, and the second engaging claw 208 is brought into engagement with the second engaging hole 408, so that ink container 200 is secured in the head cartridge 401 (FIG. 4(*c*)).

At this time, the ink supply port 203 of the ink container 200 is connected with a filter 405 provided in the head cartridge 401, thus enabling supply of the ink into the recording head 411.

However, there is a liability that user stops the mounting operation at the stage shown (b) of this Figure not to the extent of (c).

In such a case, the mounting of the ink container 200 to the head cartridge 401 is incomplete with the result of incomplete connection between the ink supply port 203 and the filter 405, which may prevent the ink supply to the recording head 411.

The incomplete connection between the ink supply port 203 and the filter 405 may leads to evaporation of the ink through the gap resulting from the incomplete connection, and then, the printer system may be damaged due to the alternation of the ink property and/or the solidification of the ink.

Figure 5:
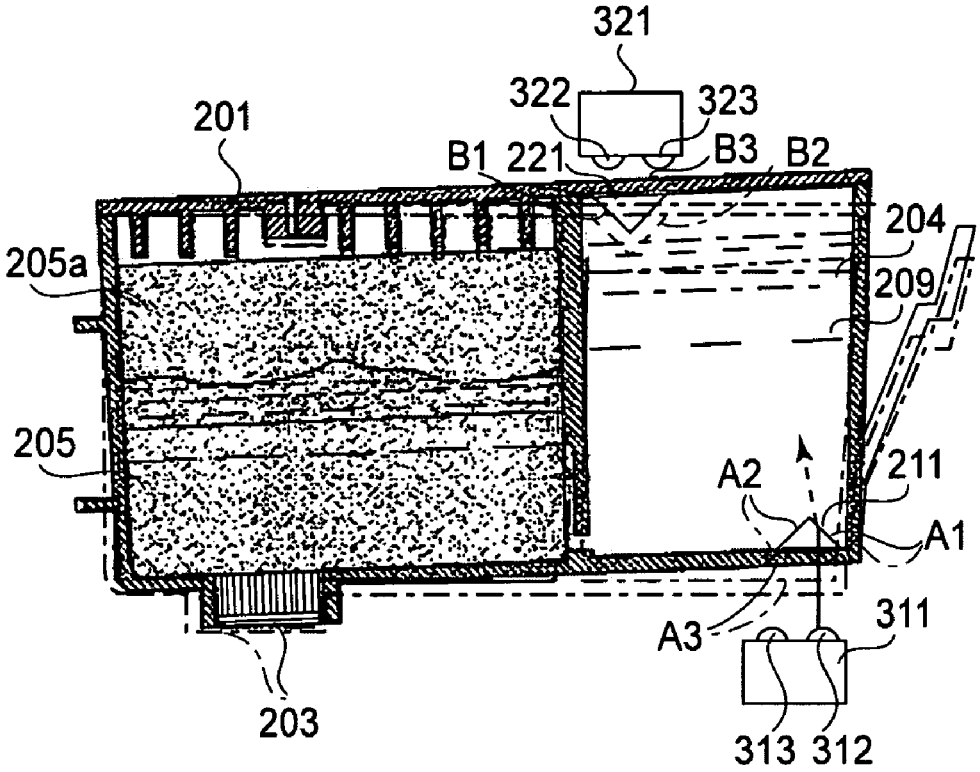
FIG. 5 is a sectional side elevation of an ink container of the first embodiment in a horizontal use.

FIG. 5 is a sectional side elevation showing the position in which the ink container 200 is placed in the head cartridge (not shown).

The chain lines show the state in which the mounting is completed, and the solid lines indicate the incomplete mounting state.

With the incomplete mounting state, the rear part of the ink container 200 is raised, and therefore, the prism A211 and the prism B221 of the ink container 200 are inclined as compared with the case of complete setting.

Thus, the angle of the light from the light emission element 312 of the sensor B321 or the sensor A311 relative to the first interface A1 or B1 of the associated prism A211 or B221 is deviated from the intended angle.

This results in a difference in the optical path in the prism.

Figure 6:
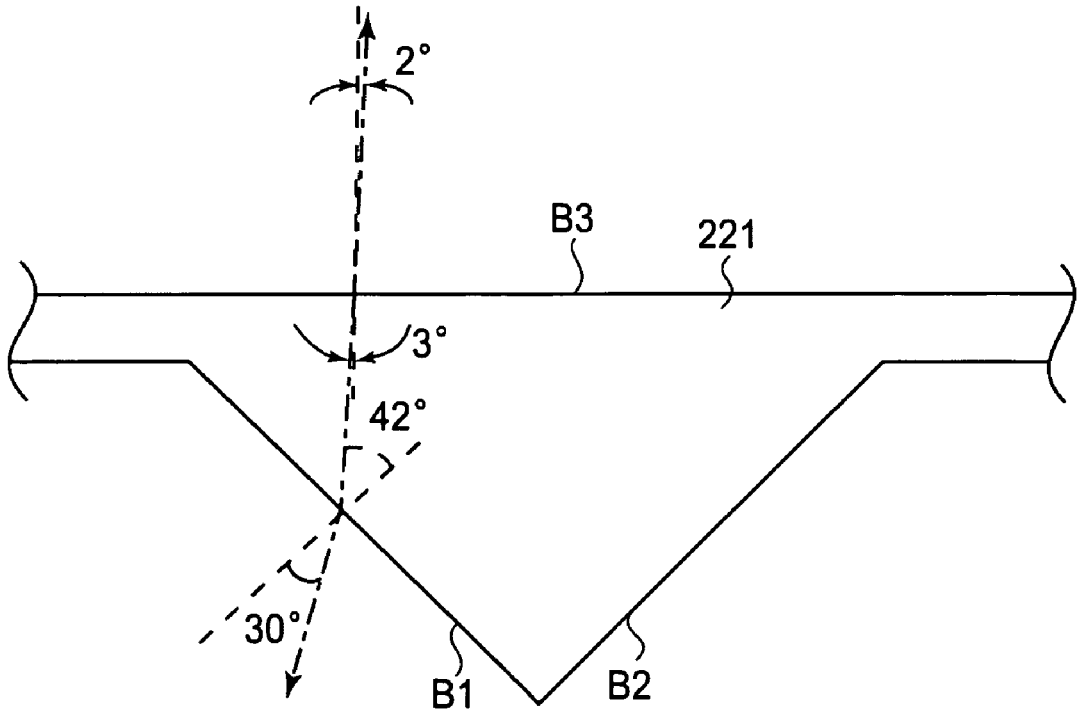
FIG. 6 is an enlarged view of a prism portion when the container of the embodiment of the present invention is oblique.

FIG. 6 is an enlarged view of the optical path in the prism B221.

In this Figure, the ink container 200 is shown as being 2° inclined by 2 degrees as a result of the incomplete mounting.

In this case, the incident angle of the light emitted from the light emission element 322 relative to the incident surface of the prism (the third surface of the prism B221 which is the upper surface of the ink container) is 2 degrees. Here, the intended angle (when the mounting is complete) is zero degrees.

The light from the light emission element 322 is incident on the third interface B3 of the prism 221 of the polypropylene resin material from the air at the incident angle of 2°.

Since the refractive index of the polypropylene resin material is 1.48, and the refractive index of the air is 1.0003, the Snell's law determines $$\sin\theta = 1.48/1.003 \times \sin 2^\circ$$

Therefore, $\theta = 3^\circ$

Thus, the light travels in the prism at the refraction angle of 3°, and is reaches the first interface of the prism B221 at the incident angle of 42°.

On the other hand, the critical refraction angle between the polypropylene resin material and the air is calculated as being 42.5° by the Snell's law.

Therefore, when the incident angle is larger than 42.5°, the light is totally reflected.

However, as described hereinbefore, the incident angle at the first surface B1 of the prism B221 is 42°, and therefore, the light is refracted by the first surface B1 and travels into the air in the ink chamber 204. That is, it does not return to the light receiving element 323.

The output of the light receiving element 323 is the same as in the case that ink container 200 is not mounted to the printer 301.

Therefore, the ink jet recording apparatus 301 is capable of warning the user of the incompleteness of the mounting of the ink container 200 or of the absence of the ink container 200.

In the foregoing description" the inclination of the ink container 200 is 2°. However, if the angle is larger than 2°, the incident angle at the surface of the prism is larger than 42.5°.

Therefore, if the ink container 200 is inclined at more than 2°, the above-described condition is met, but the angle is different depending on the refractive index of the material of the ink container 200 and the material of the prism B221.

Figure 7:
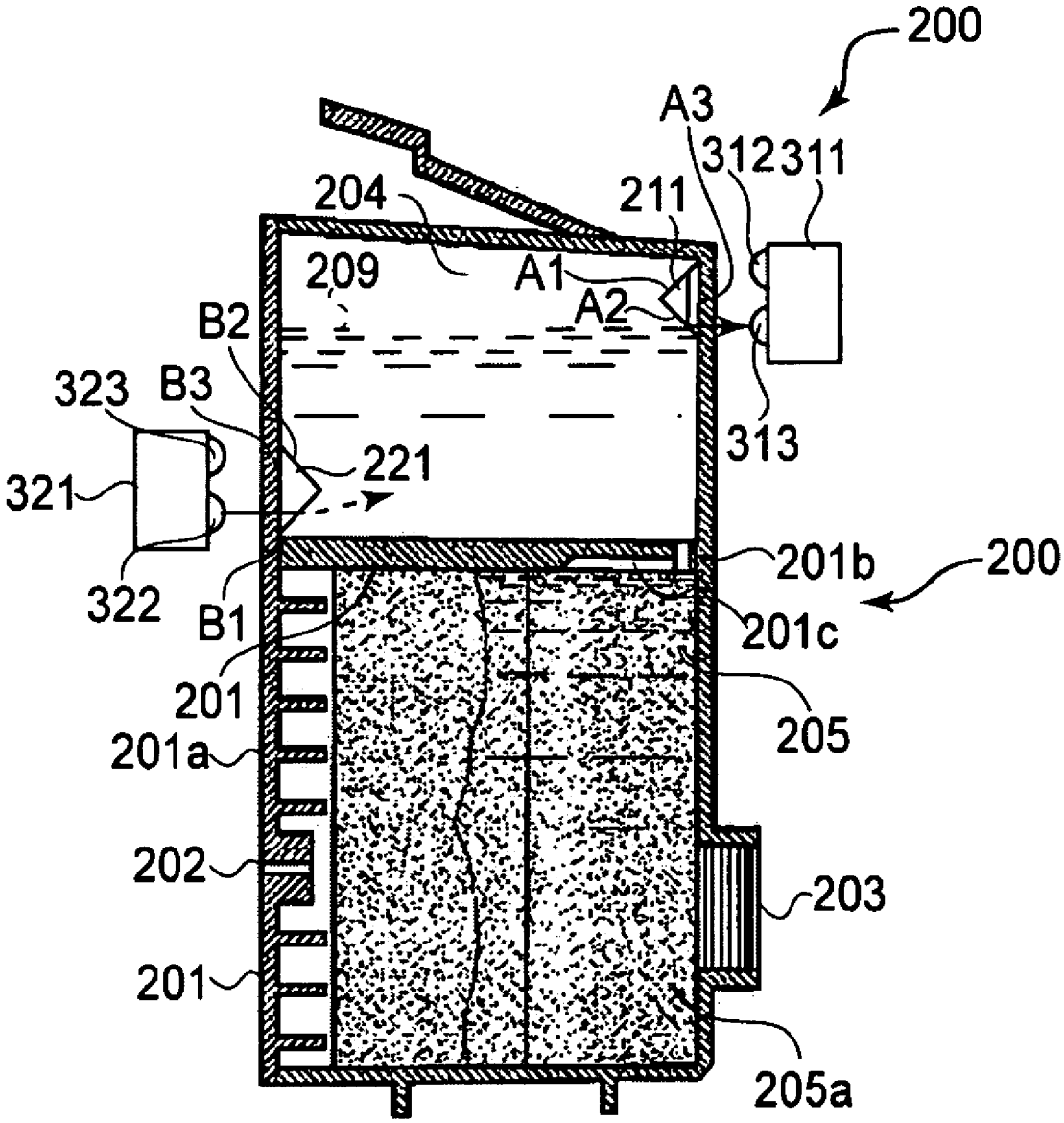
FIG. 7 is a sectional side elevation of the ink container of the first embodiment in vertical use at the initial stage of use.

Referring to FIG. 7, there is shown an ink container 200 of horizontal use, that is, the ink container 200 is rotated through 90°, wherein the ink chamber 204 takes an upper position, and the ink supply port 203 is directed horizontally.

This state is called vertical position or orientation use.

Therefore, FIG. 7 is a sectional side elevation of the ink container in the vertical orientation use.

In the vertical orientation use, the ink chamber 204 takes the position above the absorbing material chamber 205, the lateral side in the foregoing horizontal orientation use is the upper surface in the present use, and the partition. 201*a* is the bottom surface of the ink chamber 204 in this use. The prism A211 is adjacent the upper surface of the ink chamber 204, and the prism B221 is adjacent the bottom surface of the ink chamber 204.

With this state, the ink chamber 204 contains the ink and the air, and the latter is at the upper position in the ink chamber 204.

Therefore, the two surfaces A1, A2 of the prism A211 is surrounded by the air in the ink chamber 204. The sensors A311, B321, similarly to the horizontal use, are faced to the prisms A211, B221 of the ink container 200 placed in the horizontal position, respectively.

As described hereinbefore, the light from the sensor A311 is transmitted through the prism A211 and is subjected to the total reflection by the first surface A1 and the second surface A2 and is received by the light receiving element 313. By this, the light receiving element 313 produces a predetermined output voltage, on the basis of which the presence of the ink container 200 is detected.

The two surfaces B1, B2 constituting the prism B221 are in contact with the ink 209 in the ink chamber 204. Therefore, as described hereinbefore, the light from the sensor B321 is refracted by the prism B221 and enters the ink 209. Thus, no optical path is formed toward the light receiving element 323, and therefore, the presence of the ink in the ink container 200 can be detected.

With the consumption of the ink from the ink container 200 by the ink ejection or the like from the recording head, the ink is first supplied from the absorbing material chamber 205.

When the ink in the absorbing material chamber 205 is consumed to such an extent that ink level lowers beyond the end of the ambient air introduction path 201*c*, the air is introduced through the air vent 202 and passes through the absorbing material chamber 205. Correspondingly, the ink is supplied from the ink chamber 204 into the absorbing material chamber 205 through the communication port 201*b*.

Figure 8:
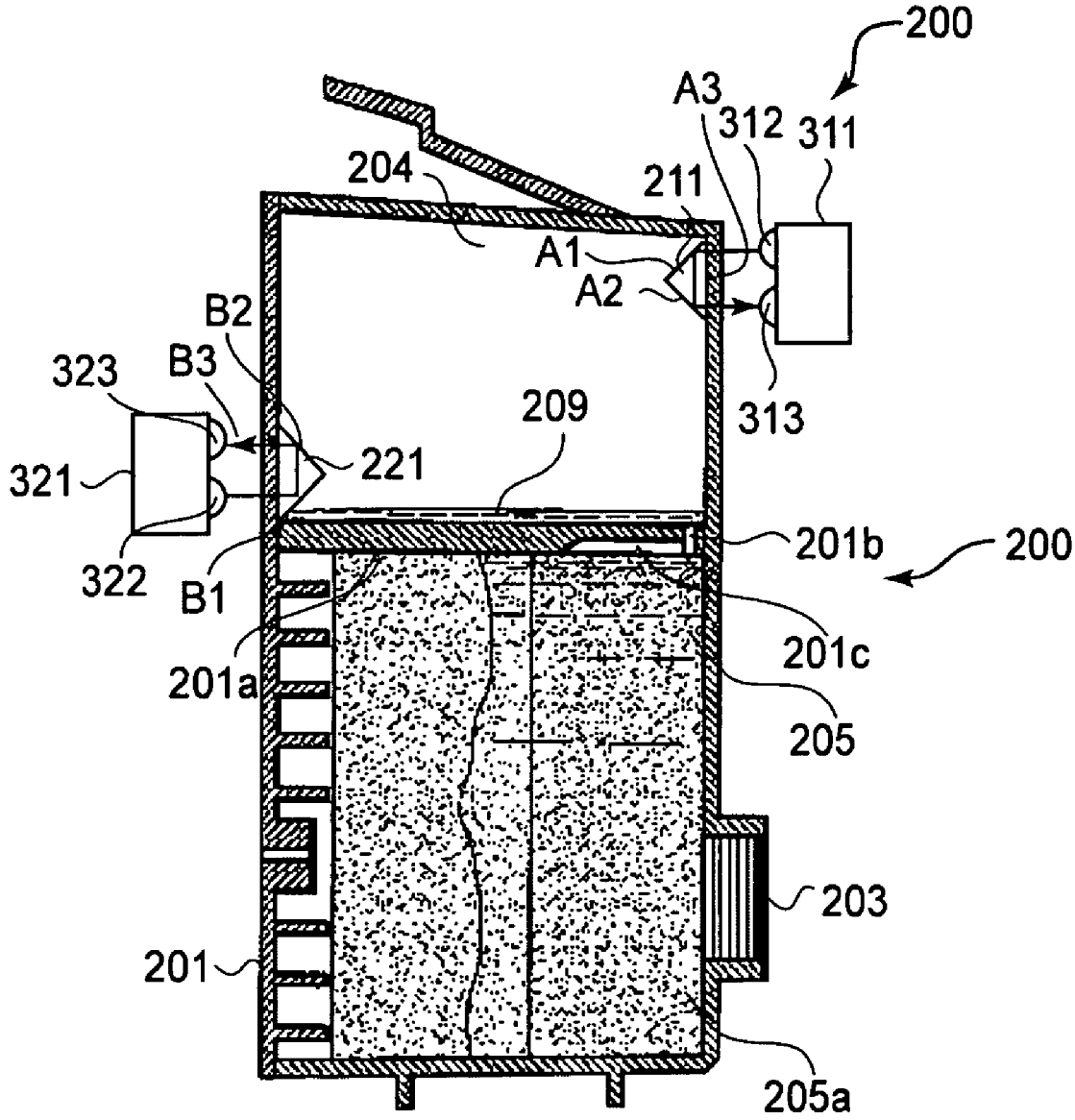
FIG. 8 is a sectional side elevation of the ink container of the first embodiment in the vertical use wherein the ink container is empty.

FIG. 8 is a sectional side elevation of the ink container 200 wherein the ink in the ink chamber 204 has been consumed to the level adjacent the bottom surface (partition 201*a*) of the ink chamber 204.

With this state, the two surfaces B1, B2 of the prism B221 are exposed to the air in the ink chamber 204.

As described hereinbefore, the light from the light emission element 322 of the sensor B321 transmits the prism B221 and is reflected to be incident on the light receiving element 323.

As a result, the light receiving element 323 produces a predetermined voltage, by which the almost empty state of the ink of the ink chamber 204 is detected. At this time, the prism A211 is kept exposed to the air from the state of FIG. 7, and therefore, the light receiving element 313 keeps the output indicative of the presence of the ink container 200.

The detection of the incomplete mounting of the ink container 200 having been described in conjunction with FIG. 5 applies to this vertical orientation use.

As described in the foregoing, the following is a Table of states of ink container which can be detected on the basis of the outputs from the sensors in the respective orientations of use.

In this Table, "H" means that output voltage of the light receiving element produced in response to the arrival of the light thereto along the optical path formed in the prism exceeds a preset threshold, and "L" means that it does not exceed the same.

TABLE 1

| | Output of light receiving element | | |
|---|---|---|---|
| | Snsr A | Snsr B | States |
| HRZNTL | L | L | no container or incomplete mounting |
| | L | H | presence of container & presence of ink |
| | H | H | presence of container & absence of ink |
| VERTICAL | L | L | no container or incomplete mounting |
| | H | L | presence of container & presence of ink |
| | H | H | presence of container & absence of ink |

As will be understood from the Table, the ink container 200 is provided with two prisms, and the ink jet recording apparatus is provided with two sensors, correspondingly.

By doing so, the presence-absence of the ink container or the mounting incompleteness and the presence-absence of the ink can be detected irrespective of the orientation (horizontal or vertical) of the ink container.

A serial type ink jet recording apparatus usable with the ink container according to the embodiment of the present invention will be described.

Referring to FIG. 16, there is shown an ink jet recording apparatus 301 comprising a carriage 302, a guiding shaft 303 and a carriage supporting portion 307 supporting the guiding shaft 303, wherein the carriage 302 is movable reciprocally in the directions of an arrow X (main scan direction).

The carriage 302 is reciprocated in the main scan direction by a drive transmission mechanism (unshown) including a carriage motor and a belt for transmitting the driving force from the carriage motor, for example.

On the carriage 302, the above-described head cartridge 401 is detachably mounted, and the head cartridge 401 is loaded with a plurality of ink containers 200 each having the above-described structure.

The plurality of ink containers 201 on the head cartridge 401 may contain different coloring material.

For example, they may contain black ink, cyan ink, magenta ink and yellow ink, respectively.

Additionally, they may include an ink container or ink containers containing substantially transparent liquid for enhancing the coloring property or durability of the ink on the recording material.

The bottom surface portion, in FIG. 16, of the head cartridge 401 has a plurality of recording heads or nozzle arrays for ejecting the respective inks or processing liquid.

In FIG. 16, a supporting table 305 provided at the bottom has a sheet feeding port 306 for supplying the recording material P.

The recording material P inserted into the sheet feeding port 306 is fed in a sub-scan direction indicated by an arrow Y by a feeding roller 309 onto a platen 308 faced to the head cartridge 401.

In the ink jet recording apparatus 301 of this example, the ink is ejected from the recording head onto the recording material P which is being fed on the platen 308, while moving the head cartridge 401 in the main scan direction.

The feeding operation of the recording material P in the sub-scan direction (Y direction) perpendicular to the main scan direction (X direction) and the scanning operation in the main scan direction are repeated to effect recording on the recording material P.

Figure 17:
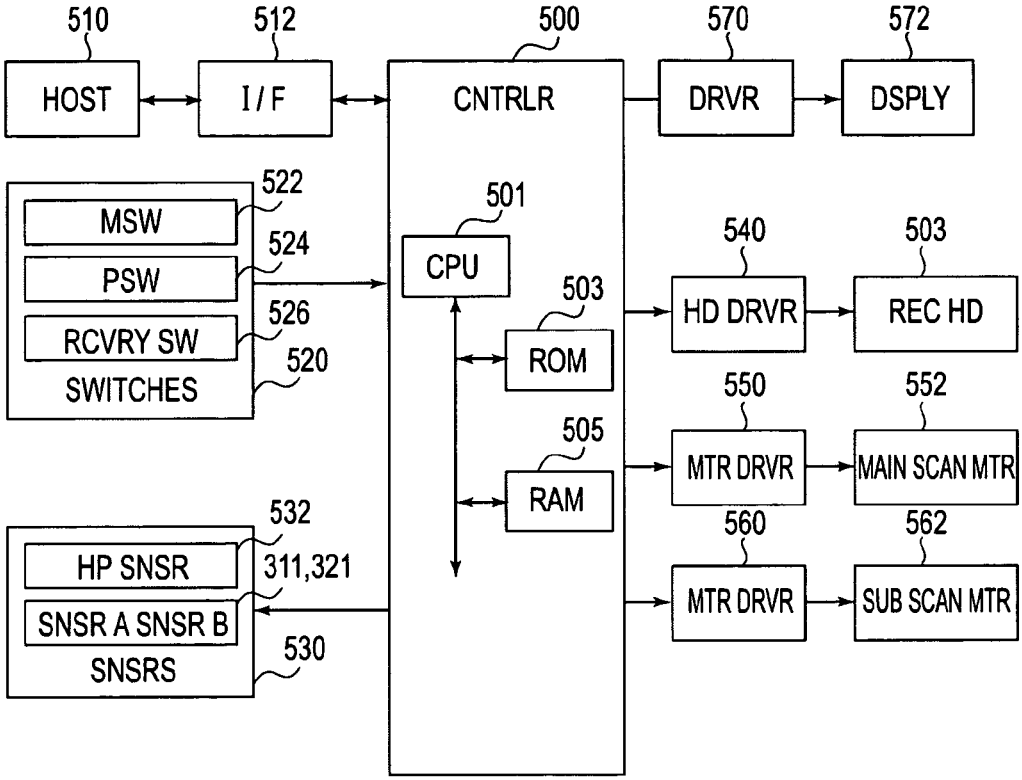
FIG. 17 is a block diagram showing a substantial structure of a control system of the ink jet recording apparatus.
Figure 18:
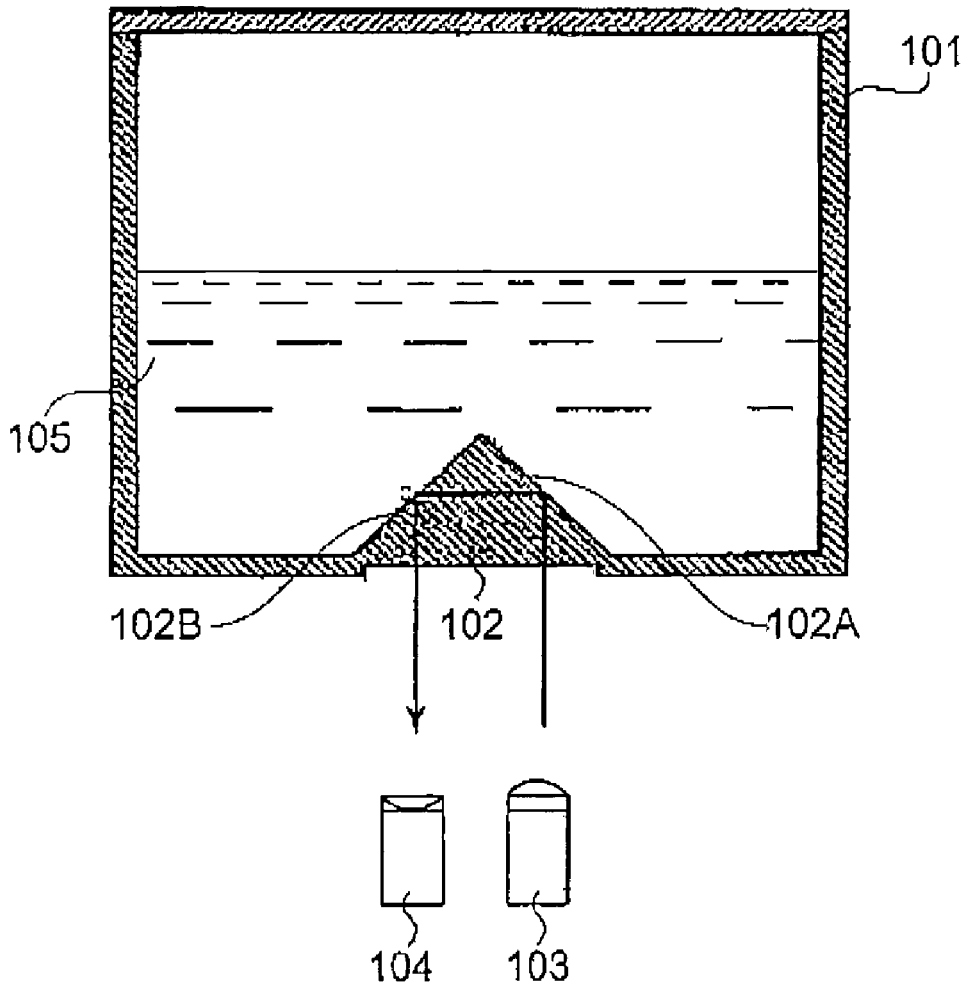
FIG.18 (PRIOR ART)
FIG. 18 is a sectional side elevation of a conventional ink container, illustrating a remaining ink amount detecting method.

Referring to FIG. 17, a control system provided in the ink jet recording apparatus will be described.

As shown in FIG. 17, there is provided a controller 500 including a CPU501 which functions to carry out various processing, discrimination and control.

In the system, there are provided a ROM 503 storing programs for the controlling operation, predetermined tables and other data, and a RAM 505 or the like having an area for converting the recording data and an area for various processing operations. It functions as an entire control means for the ink jet recording apparatus.

The controller 500 is connected with a host computer 510 which is a supply source of the recording data, through an interface (I/F) 512.

Between the controller 500 and the host computer 510, the recording data, the command, the status signal or the like are transmitted through the interface 512.

Switches 520 functions to accept the operator's instructions and include a main switch 522, and switches 524 for instructing start and stop of the recording operation.

Sensors 530 include various sensors for detecting the states of various parts of the apparatus.

For example, they include sensors A311, B321, and a home position sensor 532 for detecting that carriage is at the home position.

In addition, they include sensors A311 and B321 as the remaining ink amount detecting means for detecting the remaining ink amount in the ink container.

A head driver 540 functions to drive the recording heads 503 in the head cartridge 401 carried on the carriage 302 in accordance with the recording data or the like.

A motor driver 550 functions to activate the main-scanning motor 552, and a motor driver 560 functions to activate the sub-scan motor 562 for feeding the recording material in the sub-scan direction.

A driver 570 functions to activate a displaying device 572 for displaying various states including shortage of the remaining ink amount in the ink container beyond a predetermined level.

As described in the foregoing, in the ink jet recording apparatus of this embodiment, the CPU501 activate the light emission elements 312, 322 of the sensor A, sensor B to emit light.

On the basis of the output signals of the light receiving elements 313, 323, the discrimination is made as to the remaining ink amount in the ink container, the presence or absence of the ink container and the mounting state of the ink container.

Furthermore, the CPU501 actuate the driver 570 to display the result of the discrimination on the displaying device 572.

The result of the discrimination of the CPU501 may be fed to the host computer 510 through the interface 512, and the result of the discrimination may be displayed on the display connected with the host computer 510.

The ink jet recording apparatus of this example, as shown in FIG. 16 is usable in the state in which the sheet feeding port 306 faces the front (horizontal use).

Additionally, the ink jet recording apparatus is usable in the vertical position or orientation (vertical use) in which the sheet feeding port 306 faces upward, more particularly, the position provided by rotating the ink jet recording apparatus by 90° as indicated by an arrow A.

In the horizontal use of the ink jet recording apparatus, the ink container is in the horizontal use state shown in FIG. 1-FIG. 6, FIG. 9-FIG. 11 and FIGS. 14 and 15.

In the case of the vertical use, the ink container is in the vertical use state shown in FIGS. 7, 8, 12 and 13.

Therefore, irrespective of the position state of the ink jet recording apparatus (vertical or horizontal), the remaining ink amount can be detected with certainty.

Although the ink jet recording apparatus is usable in both vertical orientation and horizontal orientation, the ink container 200 is usable both with an ink jet recording apparatus for the vertical orientation use only and an ink jet recording apparatus for the horizontal orientation use only.

Second Embodiment

Figure 9:
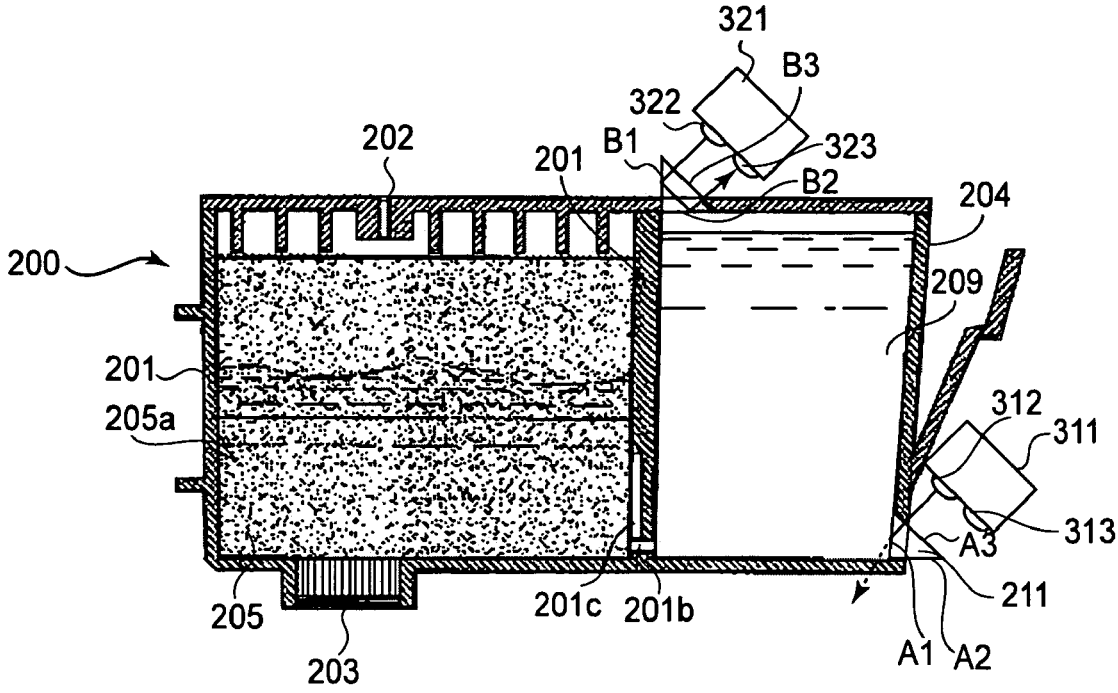
FIG. 9 is a sectional side elevation of an ink container in horizontal use according to a second embodiment of the present invention at the initial stage of use.

FIG. 9 is a sectional side elevation of an ink container according to a second embodiment of the present invention wherein the ink container is in the initial state of use.

The fundamental structure of the ink container 200 of this embodiment is similar to the ink container 200 of the first embodiment, but is different in the orientations of the prisms 211A, 221B.

More particularly, the prism A211, in the horizontal use of the ink container as shown in FIG. 9, is integrally formed adjacent the bottom portion of the ink chamber 204 formed on the casing 201 of the ink container 200.

Of the two surfaces A1, A2 constituting the prism A211, one surface (first surface) A1 constitutes a part of the ink chamber 204 and is in contact with the ink contained in the ink chamber 204.

The other surfaces (second surface) A2 and the third surface A3 of the prism A211 are integral with a side surface of the ink chamber 204 and are always in contact with the ambient air.

The surface of the prism A211 (the third surface) on which the light from the light emission element 312 of the sensor A311 is incident is inclined by 135° relative to the bottom surface of the ink container 200 (the horizontal surface in the state of FIG. 16).

A sensor A311 is provided at a position facing the third surface A3 in the ink jet recording apparatus shown in FIG. 16.

The light emitted by the light emission element of the sensor A is incident on the third surface A3 at the angle of 90° (incident angle is zero). The light receiving element of the sensor A is juxtaposed with the light emission element 312 facing the surface A3.

The prism B221 is provided integrally with the upper surface of the ink chamber 204.

Of the two surfaces B1, B2 constituting the prism B211, one surface (second surface) B2 constitutes a part of the ink chamber 204 and is in contact with the ink contained in the ink chamber 204.

The other surface (first surface) B1 of the prism B211 is integral with a top surface of the ink chamber 204 and are always in contact with the ambient air. The surface of the prism B211 (the third surface) B3 on which the light from the light emission element 322 of the sensor B311 is incident is inclined by 135° relative to the top surface of the ink container 200 (the horizontal surface in the state of FIG. 16).

A sensor B321 is provided at a position facing the third surface B3 in the ink jet recording apparatus shown in FIG. 16. The light emitted by the light emission element of the sensor A is incident on the third surface B3 at the angle of 90° (incident angle is zero). The light receiving element of the sensor A is juxtaposed with the light emission element 322 facing the surface B3 so as to receive the light passed through the prism B221.

FIG. 9 shows an initial stage state of the ink container 200, wherein the user has just mounted the ink container 200 to the printer, and the ink 209 has not yet consumed for printing operation.

With this state, one surface A1 of the surfaces constituting the prism A211 is in contact with the ink in the ink chamber 204.

Therefore, the light from the light emission element 312 is refracted at the interface and travels into the ink. The light from does not reach the light receiving element 313, which therefore provides a signal indicative of the presence of the ink in the ink chamber 204 (low voltage signal).

At this time, the second surface B2 of the prism B221 is exposed to the air in the ink chamber 204, the first interface B1 is always exposed to the ambient air.

The light from the light emission element 322 is subjected to the total reflection by the two surfaces B1, B2 and returns to the light receiving element 323. The light receiving element 323 receiving the light produces a signal having a predetermined voltage indicative of the presence of the mounted ink container 200.

The description will be made as to the detection of the remaining ink amount when the ink in the ink chamber has been consumed by the ink ejection from the head, similarly to the first embodiment.

Figure 10:
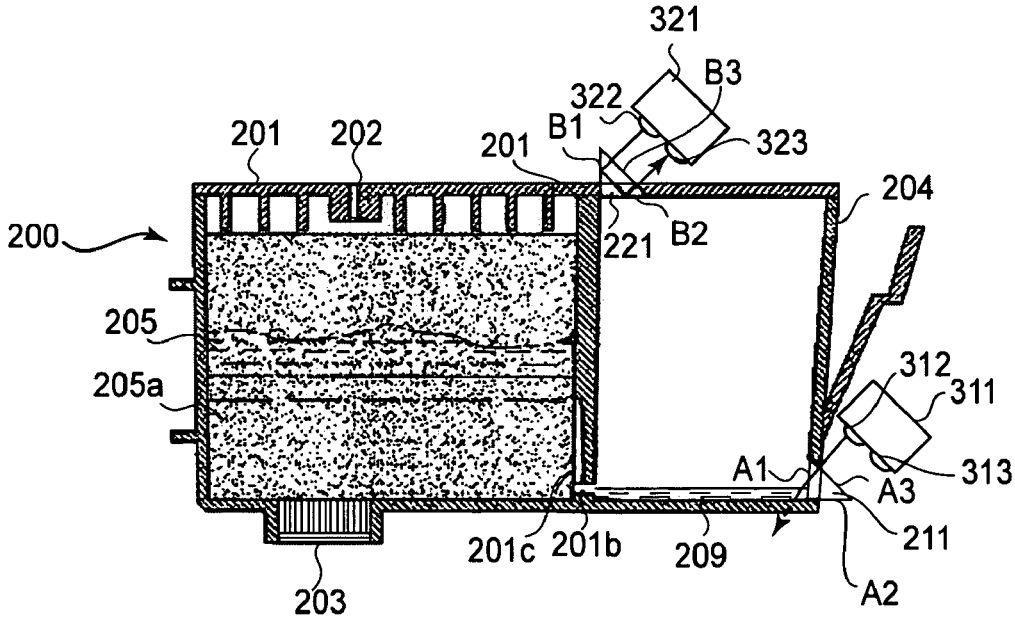
FIG. 10 is a sectional side elevation of the ink container of the second embodiment in horizontal use wherein the ink container is empty.

FIG. 10 is a sectional side elevation of the ink container wherein the ink in the ink chamber 204 has been consumed to such an extent that surface A1 constituting the prism A211 is exposed to the air.

In this citation, the two surfaces A1, A2 of the prism A211 are in contact with the air similarly to the prism B221.

Therefore, the light emitted from the sensor A311 returns to the light receiving element 313 after being totally reflected by the surfaces A1, A2. The light receiving element 313 receiving the light provides a signal (low voltage signal) indicative of the absence of the ink in the ink container 200.

Figure 11:
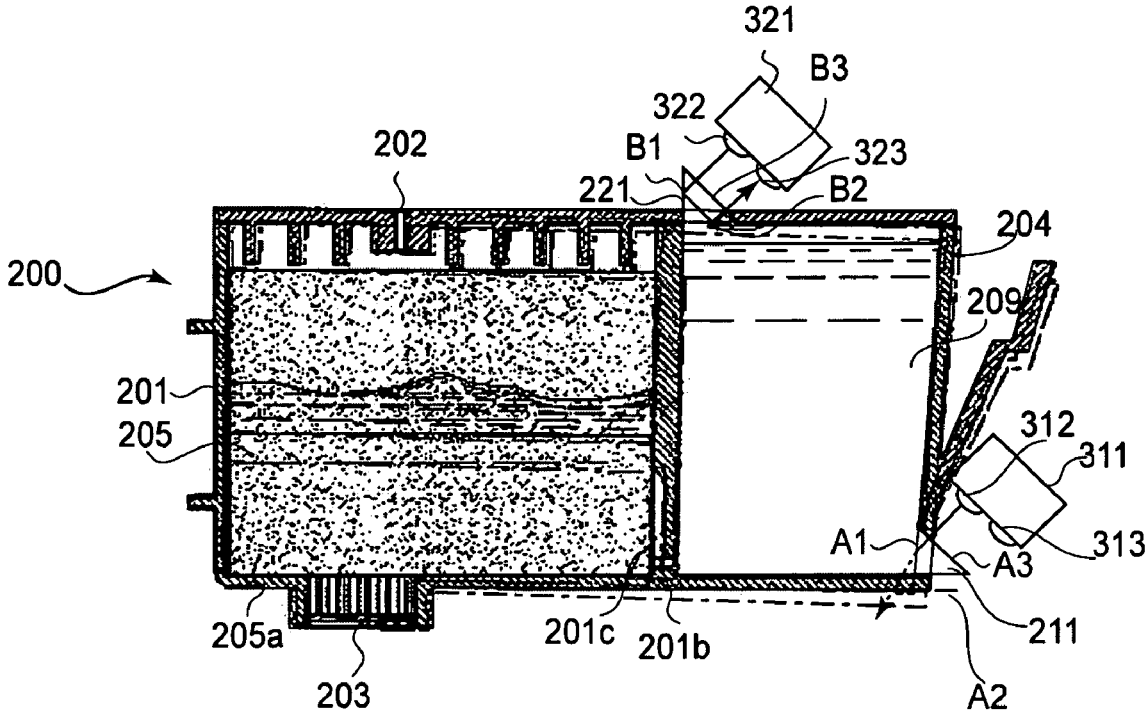
FIG. 11 is a sectional side elevation of the ink container of the second embodiment in horizontal use wherein the ink container is incompletely mounted.

FIG. 11 is a sectional side elevation showing a position of the ink container 200 mounted in the head cartridge (unshown in the Figure), wherein the chain lines show the state in which the mounting of the ink container is completed.

The solid lines show the ink container 200 incompletely mounted.

In the incomplete mounting state, the rear side of the ink container 200 is raised.

The third surfaces A3 and B3 which are the light incident surfaces of the prism A211 and the prism B221 in the ink container 200 are therefore faced inclined to the sensor A311 and the sensor B321, respectively.

As described with respect to the first embodiment in conjunction with FIG. 5, when the prism B221 is inclined by an angle more than a predetermined level, more particularly, 2° in this example, the light incident from the light emission element 322 is refracted by the third surface of the prism.

Thereafter, the light enters the ink chamber 204 (air), and does not return to the light receiving element 323.

This state is the same as with the case of the ink container 200 not mounted on the printer 301.

The ink jet recording apparatus 301 of this embodiment is capable of warning the user of the incompleteness of the mounting of the ink container 200 or the unmounting of the ink container 200, by the displaying device 572 shown in FIG. 17.

The description will be made as to the vertical use, that is, the ink container 200 is rotated by 90° to place the ink chamber 204 at the upper position.

Figure 12:
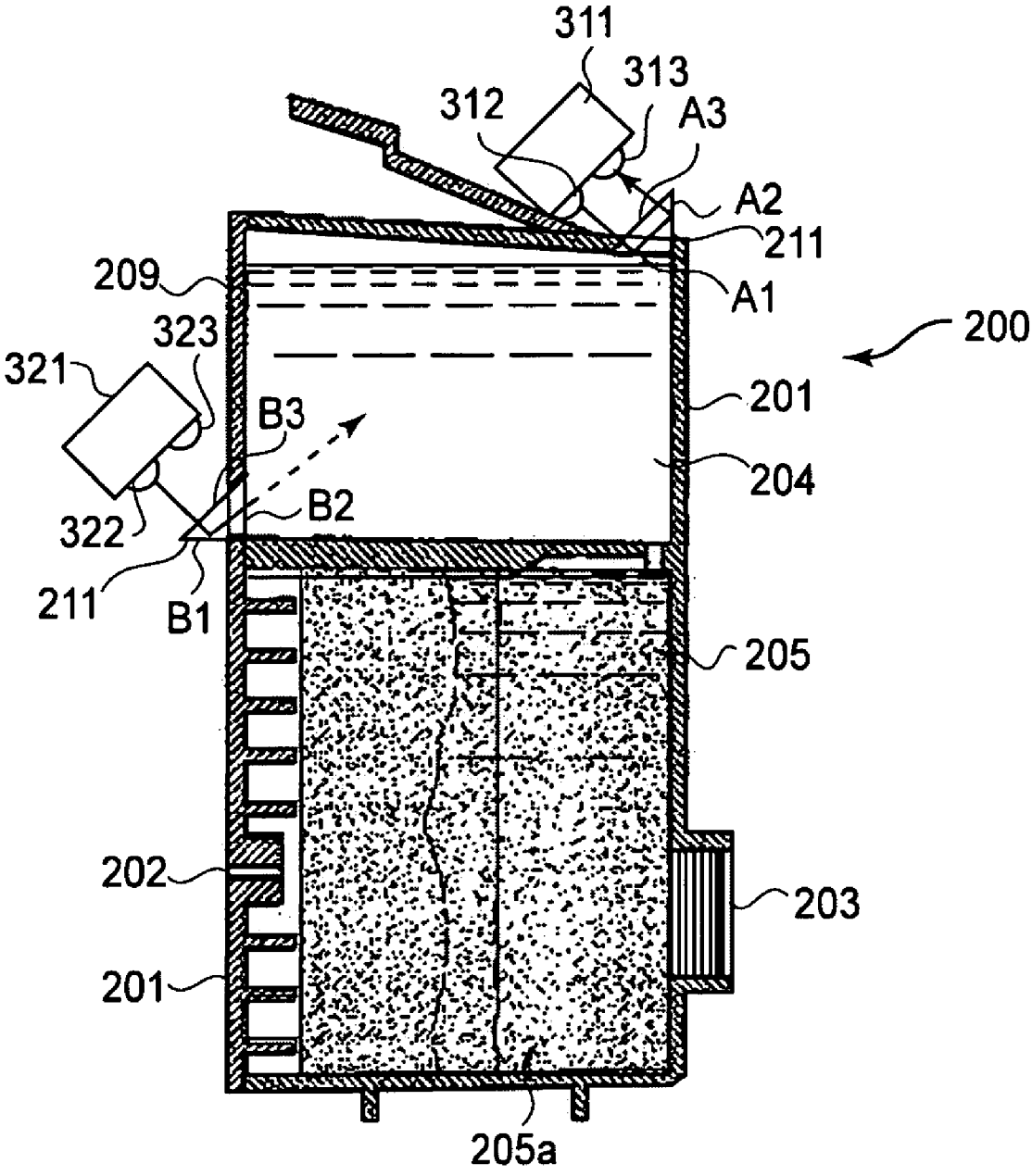
FIG. 12 is a sectional side elevation of the ink container of the second embodiment in vertical use at the initial stage of use.

FIG. 12 is a sectional side elevation of the ink container of the second embodiment in the vertical use wherein the ink container is at the initial state.

In this orientation of the container of this embodiment, the ink chamber 204 is disposed above the absorbing material chamber 205, the prism A211 is provided adjacent the upper surface of the ink chamber 204, and the prism B221 is disposed adjacent the bottom surface of the ink chamber 204.

With this state, the ink chamber 204 contains the ink and the air, and the latter is at the upper position in the ink chamber 204.

The first surface A1 constituting the prism A211 is exposed to the air in the ink chamber 204, and the second surface A2 is exposed to the ambient air as described.

Therefore, the light from the light emission element 312 is subjected to the total reflection by the two surfaces and is received by the light receiving element 313.

The light receiving element receiving the light produces a signal having a predetermined voltage indicative of the presence of the ink container 200.

One (first surface B2) of the two light receiving surfaces B1, B2 of the prism B221 is in the ink in the ink chamber 204.

Therefore, the light from the light emission element 322 is refracted at the interface and travels into the ink. The light does not reach the light receiving element 323, which therefore produces signal having a predetermined voltage indicative of the presence of the ink in the ink container 200. The surfaces B1 and the B3 are always exposed to the air outside the ink container.

The description will be made as to the detection of the remaining ink amount when the ink is consumed from the ink container 200 by the ejection or the like of the ink from the recording head.

Figure 13:
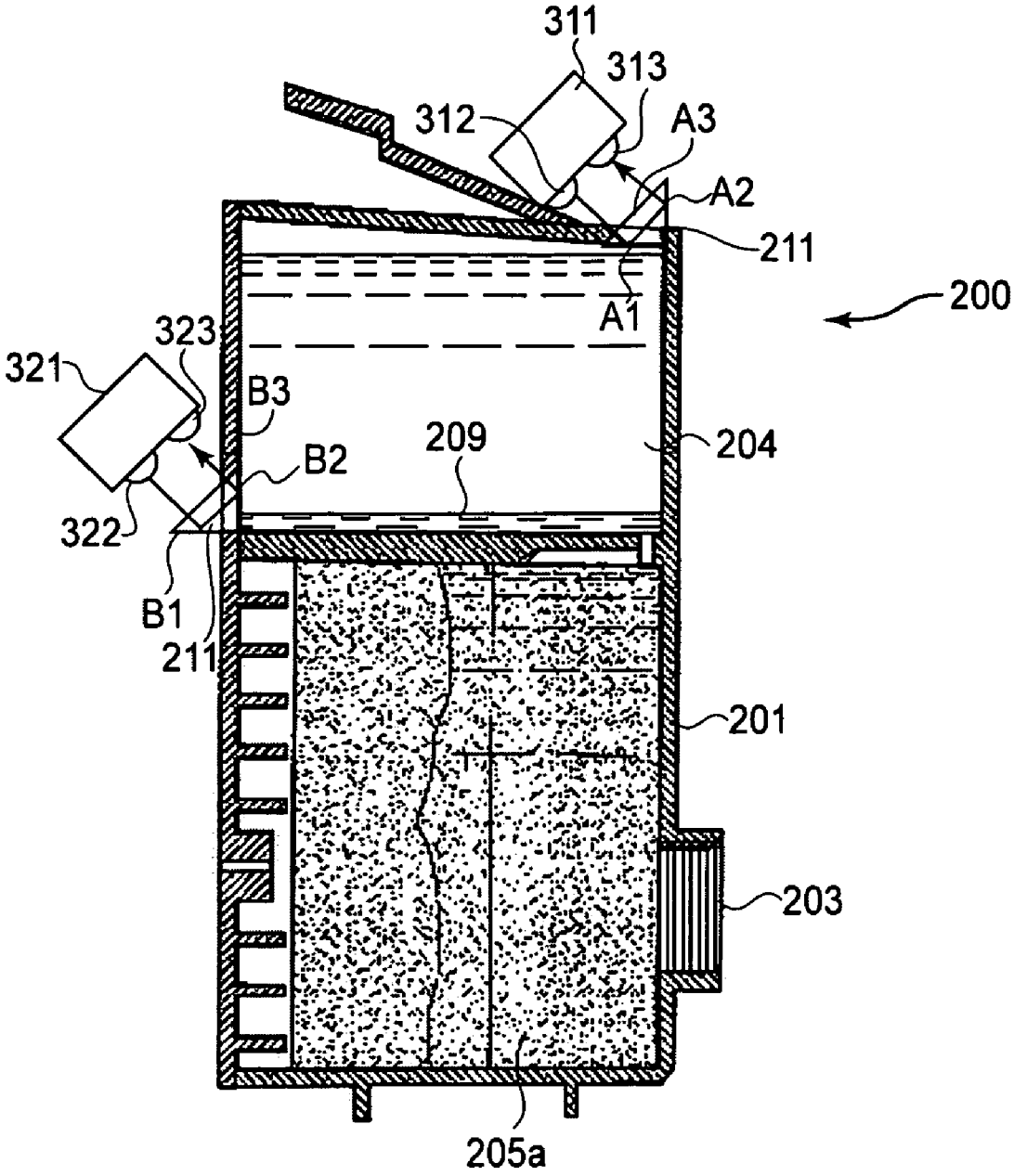
FIG. 13 is a sectional side elevation of the ink container of the second embodiment in vertical use wherein the ink container is empty.

FIG. 13 is a sectional side elevation wherein the ink has been consumed from the ink chamber 204 to such an extent that interfaces B1, B2 of the prism B221 are exposed to the air. At this time, the light from the light emission element 322 is totally reflected and is received by the light receiving element 323, since the two surfaces B1, B2 constituting the prism B221 are in contact with the air. As a result, the light receiving element 323 receiving the light produces a signal having a predetermined voltage indicative to the absence of the ink in the ink container 200.

The both sides A1, A2 of the prism A211 keep in contact with the air, and therefore, the light receiving element 313 of the sensor A311 produces a signal having a predetermined voltage indicative of the presence of the ink container.

The incomplete mounting of the ink container 200 described in conjunction with FIG. 11 can be similarly detected on the basis of the output signal from the sensors 311, 321 in the vertical use, too.

As described in the foregoing, the remaining ink amount in the ink container and the mounting of the ink container can be detected both in the vertical use and the horizontal use, similarly to the first embodiment.

Additionally, in this embodiment, the prisms A211, B221 are not projected into the ink chamber 204.

Because of this, the amount of the air to be contained in the ink chamber 204 at the initial stage can be minimized, so that ink can be contained to the neighborhood of the top inner surface of the ink chamber 204, thus improving the ink accommodation efficiency of the ink chamber 204.

The entire outer size of the ink container, however, is increased, correspondingly, since the prisms A211, B221 are projected outwardly of the casing 201.

One skilled in the art can select the first embodiment or the second embodiment depending on the situation, and the ink jet recording apparatus is constituted correspondingly.

Third Embodiment

Figure 14:
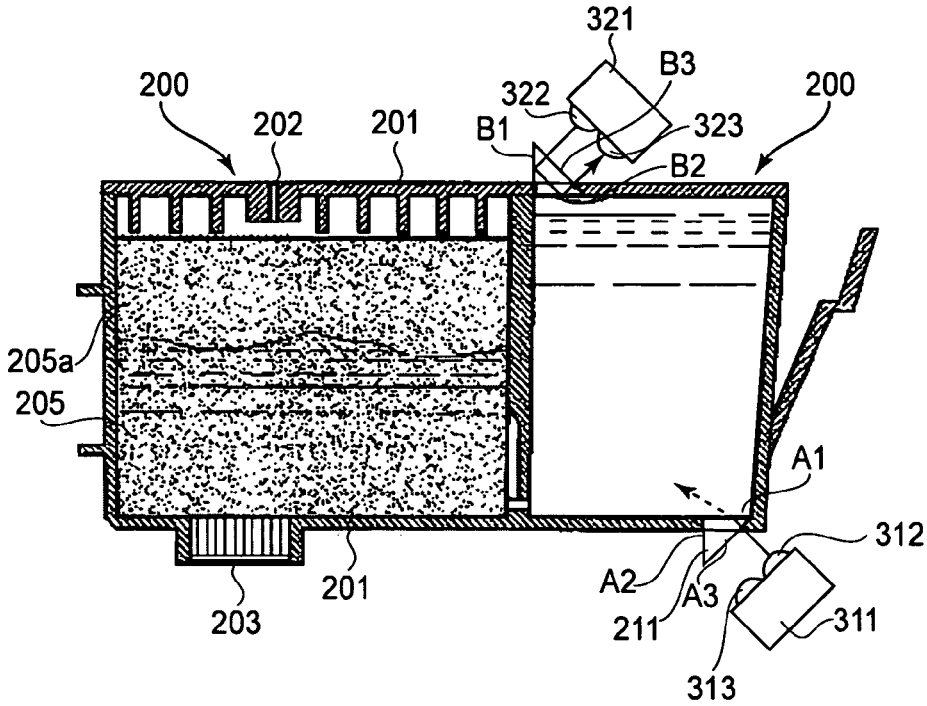
FIG. 14 is a sectional side elevation of an ink container according to a third embodiment of the present invention in lateral use.

FIG. 14 is a sectional side elevation according to a third embodiment of the present invention wherein the ink container is at the initial stage of use.

The casing and the inside structure of the ink container 200 are similar to those of the ink container of the in, but the prism A211 is provided projected downwardly from the bottom surface of the ink chamber 204 in the horizontal orientation use. This arrangement is effective to shorten the lateral size of the ink container in the horizontal use. With this embodiment, the ink container provides the function equivalent to the ink container of the first embodiment or the second embodiment.

Fourth Embodiment

Figure 15:
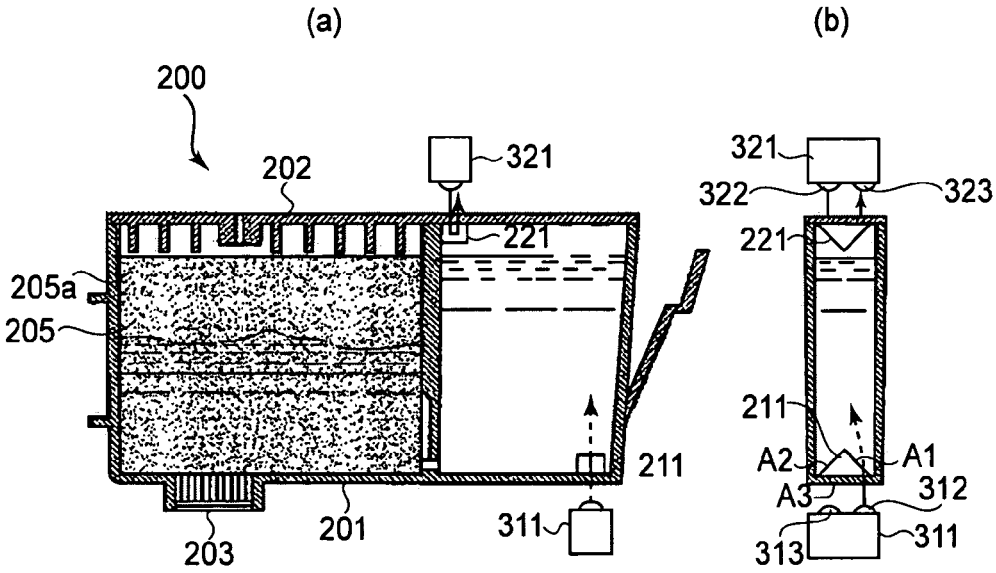
FIG. 15(*a*) illustrates an ink container according to a fourth embodiment of the present invention in horizontal use.

FIG. 15 illustrates the initial state of an ink container according to a fourth embodiment of the present invention, wherein (a) is a sectional side elevation, and (b) is a rear side sectional view.

The ink container 200 of the fourth embodiment has fundamentally the same structures as with the first embodiment.

However, this embodiment is different in that apex lines formed by the two surfaces A1, A2 and the two surfaces B1, B2 of the prism A211 and the prism B221 extend perpendicularly to the moving direction of the carriage.

In other words, the prisms A211, B221 are oriented in directions provided by rotating the ink container by 90°. The sensors are rotated by 90°, correspondingly.

By doing so, the same functions as with the first embodiment can be performed. The fourth embodiment and the first embodiment can be selected in accordance with the directions of the sensors.

Other Embodiments

In the foregoing embodiments, the liquid storing containers are the ones having the ink chamber functioning as a liquid reservoir and an absorbing material chamber, but the present invention is applicable to an ink container comprising only the ink chamber.

In the foregoing embodiments, the ink container has two so-called triangle prisms having a triangular shape cross-sectional configuration at two positions corresponding to the vertical orientation use and the horizontal orientation use.

The present invention may use another configuration prism such as a pentangular prism, trapezoidal prism or the like.

The number of the portions to be optically detected, provided on the ink container, may be changed depending on the number of the usable orientations.

In the foregoing embodiments, one of the prisms provided correspondingly to the use orientations receives the light to detect the remaining amount of the ink, and simultaneously, the prism which is not used for the remaining ink amount detection also receives the light.

With such a structure and/or method, the presence or absence of the ink container is detected, but in the case that detection of the presence or absence of the ink container is unnecessary, the optical detection portions are arranged only in consideration of the use orientation.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 356056/2004 filed Dec. 8, 2004 which is hereby incorporated by reference.

What is claimed is:

1. A liquid storing container comprising:

a liquid storing chamber for directly accommodating liquid, wherein said liquid storing chamber is provided with a supply port for supplying the liquid out of said liquid storing chamber; and at least two prisms each having at least one surface facing an inside of said liquid storing chamber;

wherein said liquid storing container is used in at least first and second orientations, wherein in said first orientation said supply port faces vertically and in said second orientation said supply port faces horizontally, and at least one of said prisms takes an upper position in said liquid storing container and another of said prisms takes a lower position in said liquid storing chamber, irrespective of whether said liquid storing container is in said first orientation or said second orientation.

2. A liquid storing container according to claim 1, wherein the one prism which takes the upper position is used for detecting presence or absence of said liquid storing container or properness of orientation of said liquid storing container, and the other prism which takes the lower position is used for detecting a remaining amount of the liquid in said liquid storing chamber.

3. A recording apparatus operable in a plurality of orientations including a horizontal orientation and a vertical orientation, said apparatus comprising:

a liquid storing chamber;

at least two prisms each having at least one surface facing an inside of said liquid storing chamber, wherein at least one of said prisms takes an upper position in said liquid storing chamber and another of said prisms takes a lower position in said liquid storing chamber, irrespective of whether said recording apparatus is operated in the horizontal orientation or the vertical orientation; and at least two pairs of a light emission element for directing a beam to a prism at a predetermined incident angle and a light receiving element for receiving the beam reflected by said prism at a predetermined reflection angle to output a detection signal, wherein one of said pairs is effective to detect presence or absence of remaining liquid and the other of said pairs is effective to detect the mounted liquid storing chamber, whereby said apparatus is operated in both of the horizontal orientation and the vertical orientation with the liquid storing chamber mounted therein.

* * * * *